US006532917B2

(12) United States Patent
Thieleke et al.

(10) Patent No.: US 6,532,917 B2
(45) Date of Patent: Mar. 18, 2003

(54) PORTABLE, INTERNAL COMBUSTION ENGINED POWER TOOL AND A METHOD OF CONTROLLING ITS OPERATION

(75) Inventors: Joachim Thieleke, Wasserburg (DE); Wolfgang Saxler, Gurtis (AT)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 09/898,392

(22) Filed: Jul. 3, 2001

(65) Prior Publication Data

US 2002/0062796 A1 May 30, 2002

(30) Foreign Application Priority Data

Jul. 4, 2000 (DE) ..... 100 32 310

(51) Int. Cl.[7] ..... B25C 1/08
(52) U.S. Cl. ..... 123/46 SC; 123/46 H
(58) Field of Search ..... 123/46 H, 46 R, 123/46 SC

(56) References Cited

U.S. PATENT DOCUMENTS 4,284,055 A * 8/1981 Wakeman ..... 123/556
5,465,702 A * 11/1995 Ferrenberg ..... 123/543
5,540,191 A * 7/1996 Clarke ..... 123/541
5,873,508 A * 2/1999 MacVicar et al. ..... 123/46 SC
6,019,072 A * 2/2000 Phillips et al. ..... 123/46 H
6,260,519 B1 * 7/2001 Phillips ..... 123/46 R

* cited by examiner

*Primary Examiner*—Gene Mancene
*Assistant Examiner*—Jason Benton
(74) *Attorney, Agent, or Firm*—Sidley Austin Brown & Wood, LLP

(57) ABSTRACT

A method of controlling operation a portable, internal combustion engined power tool including a combustion chamber (1), at least one suction/discharge valve (34)associated with the combustion chamber (1), and an operational piston (8) the method including inquiring a displacement position of the operational piston (8) of the power tool when it is being displaced to its initial position after having performed an operational stroke upon ignition of a fuel gas mixture filling the combustion chamber, and releasing the at least one suction/discharge valve (34) upon the piston (8) reaching its initial position; and a power tool which is controlled by the method.

16 Claims, 10 Drawing Sheets

PORTABLE, INTERNAL COMBUSTION ENGINED POWER TOOL AND A METHOD OF CONTROLLING ITS OPERATION

BACKGROUND OF THE INVENTION

1. Field of the Invention

The present invention relates to a portable, internal combustion engined power tool, in particular a setting tool for driving in fastening elements, and including a combustion chamber, at least one suction/discharge valve connected wit the combustion chamber, and an operational piston which performs an operational stroke upon ignition of a fuel gas mixture filling the combustion chamber. The present invention also relates to a method of controlling operation of such a power tool.

2. Description of the Prior Act

With a power tool of a type described above, the drive energy is generated by burning a fuel gas mixture in a combustion chamber and is transmitted by the operational piston to a fastening element. Upon pressing a power tool against a constructional component into which a fastening element is to be driven, an ignitable fuel gas mixture is injected into the combustion chamber. Upon actuation of a trigger, a spark is produced which ignites the fuel gas mixture, initiating a combustion process. The operational piston, which adjoins the combustion chamber, is driven by the combustion gases. At the end of its operational stroke, the piston passes past discharge openings through which the waste gases can be at least partially discharged. The piston, after having performed the operational strokes, returns in its initial position as a result of underpressure which was created in the combustion chamber by cooling of the waste or residual gases. During the period of thermal return of the piston to its initial position, the combustion chamber should remain sealed from the surrounding it environment. Therefore, the suction/discharge valves, which provide for delivery of fresh air into the combustion chamber, should be open only after the piston has returned into its initial position. Generally, the time necessary for the return of the piston into its initial position increases with the increase of the tool temperature which heats during operation. In addition, high-energy power tools require a large expansion volume which results in that a greater time becomes necessary for the return of the piston into its initial position.

In some conventional power tools, closing of a suction/discharge valve can be effected with a pawl connected by, e.g., a toggle lever with the trigger. In this way, the suction/discharge valve becomes open as soon as the trigger returns into its initial position. This means that by the time the trigger returns to its initial position, the piston also must return into its initial position.

The locking of the suction/discharge valve by the trigger means that the switching point of the trigger cannot any more be arbitrary selected. The ignition switch can only then be actuated when the locking of the suction/discharge valve has been completed, i.e., long after the start of the displacement of the trigger. However, a long trigger displacement adversely affects acceptance by the customers. Moreover, as it has already been discussed above, with a heated tool, the return of the piston into its initial position lasts longer. The tool user must, in this case, hold the trigger in its pulled condition longer to prevent the piston from occupying a erroneous position.

In order to increase the time available for return of the piston into its initial position, the trigger displacement can be damped. However, damping negatively influences operational characteristics of the trigger as a larger force is needed for actuating the trigger, and the trigger does not return sufficiently rapidly into its initial position. A user does not look at dampening favorably as it reduces the maximum setting rate and requires a greater force for actuating the trigger, which the user has to apply.

German Publication DE 19962 598.0 suggests detecting of the gas pressure in the combustion chamber after the fuel gas mixture has been ignited and locking the suction discharge valve(s) dependent on the detected gas pressure.

Accordingly, an object of the present invention is to provide a method which would permit to precisely determine when the piston returns into its initial position and thereby would provide for a more precise control of release of the suction/discharge valve.

Another object of the present invention is to provide a power tool which would contain means that would permit more precisely determine the return of the piston into its initial position.

SUMMARY OF THE INVENTION

These and other objects of the present invention, which would become apparent hereafter, are achieved by providing a method according to which the displacement position off the piston is inquired, and the suction/discharge valve is released after the return of the piston in its initial position has been ascertained.

The tool according to the present invention includes inquiry means for inquiring the piston position and which actuates a locking/release device associated with the suction/discharge valve for opening same.

According to the present invention, the method for operating a portable internal combustion engined power tool including a combustion chamber, at least one suction/discharge valve for supplying fresh air into the combustion chamber and for discharging waste gases therefrom, and an operational piston displaceable in an operational direction upon ignition of a fuel gas mixture filling the combustion chamber, includes inquiring a displacement position of the piston when it is being displaced to its initial position after having performed an operational stroke; and releasing the at least one valve upon the piston reaching its initial position.

The foregoing method permits to precisely determined the geometrical position of the piston, in particular, its initial position. The release or opening of the suction/discharge valve is effected only when the piston has reached its initial position. The pressure variations of the residual gases in the combustion chamber do not lead any more to a faulty control during the valve release. The danger of the valve being released before th piston reaches its initial position is completely eliminated. The initial position of the piston is a position in which the opening between the combustion chamber and the guide cylinder is completely closed.

In principle, for inquiring the displacement position of the piston, a position of any portion of the piston can be monitored. However, because the piston is guided in a guide cylinder and has a piston rod at least a portion of which projects from the guide cylinder, according to embodiments of the invention, it is the position of the piston rod which is being ascertained. In this case, the access to the inside of the cylinder or the combustion chamber is not any more necessary. Therefore, the inquiring element or device for determining the displacement position of the piston can be formed much simpler, and it can be mounted much easier. The displacement position of the piston can be easily ascertained from the displacement position of the piston rod. Based on the principle that it is the initial position of the piston that need be ascertained, a corresponding clearly defined point on the piston rod can be monitored, e.g., by using a stationary sensor. Passing of the defined point of the piston rod past the sensor, upon returning of the piston to its initial position, is a clear indication that the piston has reached its initial position.

According to one embodiment of the present invention, as a defined point which has to be monitored for determining the displacement position of the piston rod, the end surface of the piston rod is used. The position of the end surface of the piston rod can be monitored very easily and very precisely. This permits to precisely determine the return of the piston to its initial position.

In case, the piston rod has not returned to its initial position after the performance of the operational stroke, according to a further development of the present invention, a forceful release of the suction/discharge valve is provided for. The forceful release is provided in order to discharge the waste or residual gases from the combustion chamber. In this case, the piston must be brought into its initial position by other means, namely, manually or by a subsequent ignition of a new fuel gas mixture injectable into the combustion chamber.

According to the present invention, the portable, internal combustion engined power tool includes a combustion chamber, at least one suction/discharge valve for supplying fresh air into the combustion chamber, and for discharging waste gases therefrom, an operational piston displaceable in an operational direction upon ignition of a fuel gas mixture filling the combustion chamber, a locking/release device for release the at least one suction/discharge valve after the piston has reached its initial position after having performed operational stroke, and inquiry means for inquiring a displacement position of the piston when it is being displaced to its initial position after having performed operational stroke and for actuating the locking/release device when the piston has reached its initial position.

According to the invention, it is, thus, provided for a piston location-dependent control of the locking/release device, with the control being independent from pressure variation of the residual gases in the region of the combustion chamber.

As it has already been discussed previously, the piston, which is displaceable in a guide cylinder, has a piston rod a portion of which projects from the guide cylinder. Therefore, according to the invention, the inquiry element for determining the position of the piston is located outside of the guide cylinder in vicinity of the guide cylinder. This simplifies the design of the tool and insures an easy mounting and monitoring of the inquiry element. This position of the inquiry element insures a precise determination of the displacement position of the piston rod.

The piston rod and the inquiry element are located immediately opposite each other, whereby the inquiry of the displacement position of the piston rod is effected directly.

As it has already been discussed above, for inquiring the displacement position of the piston, a displacement position of the piston rod is monitored. As it has further been discussed above, a clearly defined point on the piston rod, which corresponds to the initial position of the piston, can be monitored. As it has still further been discussed above, as a defined point on the piston rod, the piston rod end surface is used, which is monitored with suitable sensor means. As sensor means mechanical, electrical, optical, and magnetic sensors can be used. Besides the end surface of the piston rod, as a defined point, other geometrical elements of the piston or the piston rod can be used. Also, an external elements mounted on the piston or the piston rod, such as magnets, soft iron cores, optical bar codes, can be used. However, the most advantageous element for ascertaining the return of the piston into its initial position, proved to be the end surface of the piston rod as its position can be most easily detected.

According to one embodiment of the present invention, an inquiring element can be formed as a sensor located adjacent to the displacement path of the piston rod and generating an electrical release signal as soon as the piston rod leaves the region of the sensor. The sensor generates the electrical release signal when the free end of the piston rod passes the sensor, which position of the piston rod corresponds to the initial position of the piston. To this end, the distance of the location of the sensor from the initial position of the piston is so selected that the sensor is located immediately in front of the end surface of the piston rod when the piston occupies its initial position.

The electrical release signal actuates the locking/release device which releases the suction/discharge valve(s). When the locking/release device has a locking lever, the electrical release signal can be used for a actuating an setting device that lifts the locking lever off its locking position. The locking lever is brought into its locking position by the tool trigger. The setting device retains the locking lever in its locking position until it is actuated by the electrical release signal.

According to another embodiment of the present invention, the inquiry element for inquiring or ascertaining the displacement position of the piston rod is formed as a resilient feeler biased against the circumference of the piston rod and extending into the displacement path of the piston rod when the piston has returned to its initial position. In the initial position of the piston, the feeler end is located immediately in front of the free end surface of the piston rod. Forming the inquiry element as a feeler simplifies its structure and, at the same time, provides for an inquiry element which is robust and require little maintenance. It is also not sensitive to contamination. The end of the feeler adjacent to the piston rod can be formed as a spring element, in form, e.g., of a leaf spring with a convex end, with the piston rod extending tangentially to the convex end in the displacement direction of the piston.

The locking/release device locks or releases the suction/discharge valve(s) dependent on whether the feeler engages the piston rod or extends into the piston rod displacement path, respectively. The locking or release of the valve(s) can be effected by the locking lever of the locking/release device engageable by the feeler.

The feeler can be connected with the free end of the locking lever which is displaceable into its locking position by the tool trigger. The locking lever remains in its locking position after the ignition of the fuel gas mixture in the combustion chamber as long as the feeler engages the circumference of the piston rod.

According to an advantageous embodiment of the present invention, there is provided a setting device that displaces the locking lever in its release position as soon as the piston has returned into its initial position. As the feeler element is formed as a mechanical element engageable with the circumference of the position rod, it is formed as a resilient element as it need be compressed upon the pivotal movement of the locking lever in its release position.

As a setting device, e.g., an actuation button, which is actuated manually and is connected with the locking lever, can be used.

However, the setting device can be also formed as an angular lever pivotally supported at its apex, with one leg of the angular displacing the locking lever of the locking/release device into its locking position when the other leg of the angular lever is displaced by a press-on element, which is supported in the tool housing, upon the displacement of the press-on element to the rear of the tool. The displacement of the other leg provides for pivoting of the angular lever in a respective direction. If, for some reasons, the piston has not returned in its initial position after performing its operational stroke, the tool can again be pressed against the constructional component to displace the locking/release device or its locking lever into the release position, which insures release of the suction/discharge valves(s) and deaeration of the combustion chamber. With a subsequent press-against process, the fuel gas again is injected into the combustion chamber, and the working process is conducted with the piston spaced from its initial position. However, in this condition of the piston, no fastening element is located in the outlet channel of the tool, so that there is no any danger of injury. Upon return of the piston in its initial position, the normal operation of the tool is resumed.

The novel features of the present invention, which are considered as characteristic for the invention, are set forth in the appended claims. The invention itself, however, both as to is construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
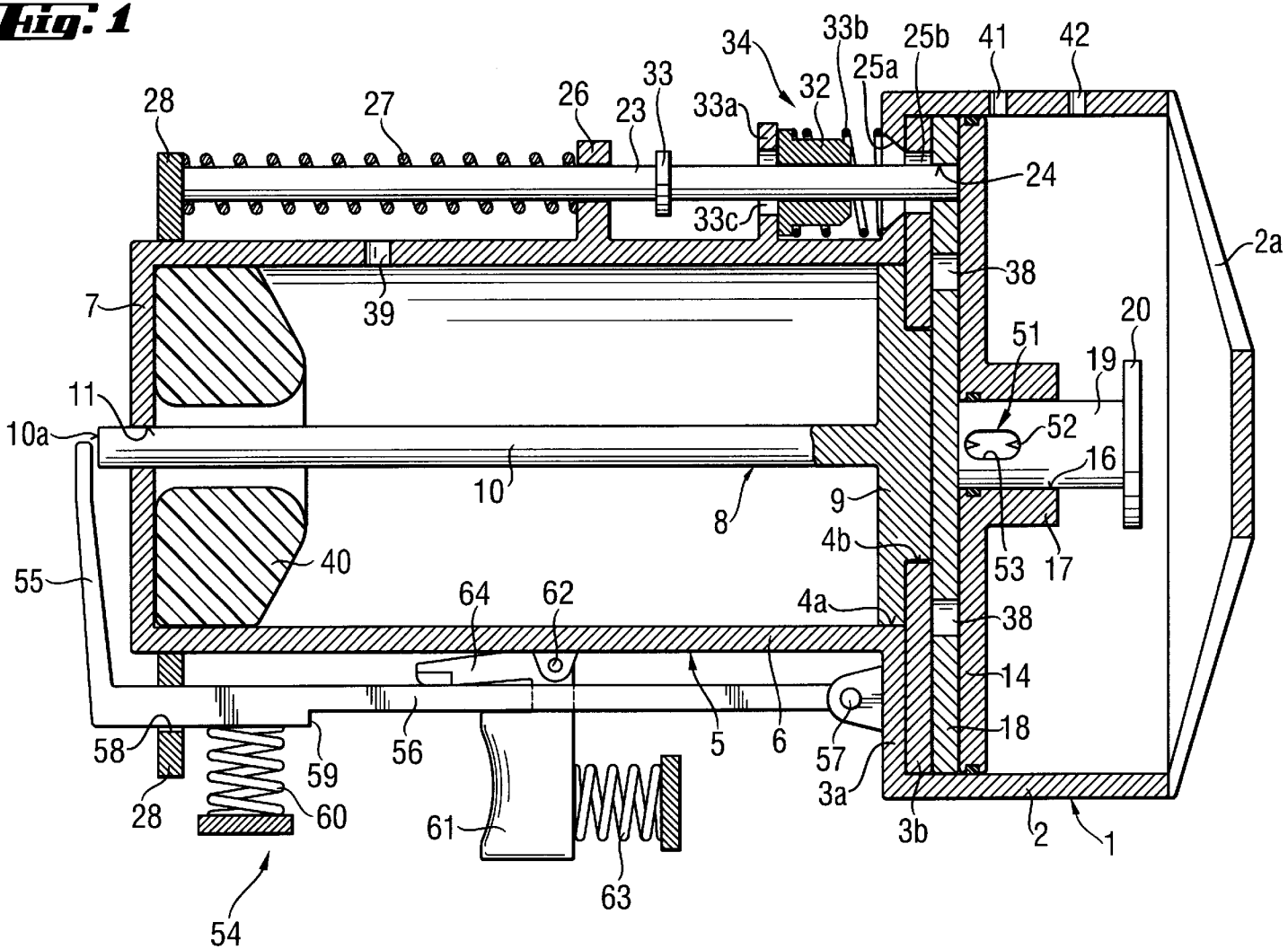
FIG. 1 an axial cross-sectional view of a first embodiment of a power tool according to the present invention in the region of its combustion chamber in a completely collapsed condition of the combustion chamber sections.

A combustion engined power tool according to the present invention, which is shown in FIGS. 1–6, includes a cylindrical combustion chamber 1 with a cylindrical wall 2 and an adjoining the cylindrical wall 2, circular bottom 3*a,* 3*b.* In the center of the bottom 3*a,* 3*b,* there is provided an opening 4*a,* 4*b.* A guide cylinder 5, which has a cylindrical wall 6 and a bottom 7, adjoins the opening 4*a,* 4*b.* A piston 8 is slidably displaceable in the guide cylinder 5 in its longitudinal direction. The piston 8 is formed of a piston plate 9 adjoining the combustion chamber 1 and a piston rod 10 located centrally with respect of the piston plate 9. The piston rod projects through an opening 11 formed in the bottom 7 of the guide cylinder 5.

In FIG. 1, the piston 8 is shown in its initial position corresponding to a non-operational condition of the power tool which is formed as a setting tool for driving fastening elements into constructional components. A surface of the piston plate 9, which is adjacent to the combustion chamber, adjoins, to a lesser or greater degree, the bottom 3*a,* 3*b,* and the free end of the piston rod 10 only slightly projects past the bottom 7 of the guide cylinder 5. The diameter of the piston plate 9 is stepwise reduced in the direction of the combustion chamber 1, with a smaller diameter portion lying in the opening portion 4*b* and a larger diameter portion lying in the opening portion 4*a.* In this way, the larger diameter portion of the piston plate 9 abuts the bottom plate 3*b* which forms a stop for the piston 8 in the initial position of the piston. For sealing the space on opposite sides of the piston plate 9, sealing rings (not shown) can be provided in the outer circumference of the piston plate 9.

Within the combustion chamber 1, there is located a cylindrical plate which can be called a combustion chamber wall 14. The combustion chamber wall 14 is displaceable in the longitudinal direction of the combustion chamber 1 and is provided in its outer circumference with an annular sealing to seal the space in front of and behind the combustion chamber wall 14. The combustion chamber wall 14 has a central opening 16 in the wall of which there is arranged an annular sealing.

An annular separation plate 18 is arranged between the bottom plate 3*b* and the combustion chamber wall 14. The separation plate 18 has a diameter that corresponds to the inner diameter of the combustion chamber 1. At its surface adjacent to the combustion chamber wall 14, the separation plate 18 is provided with a cylindrical lug 19 which extend through the central opening 16 of the combustion chamber wall 14. The length of the lug 19 exceeds the thickness of the combustion chamber wall 14 in several times. The sealing, which is provided in the wall of the opening 16, snuggly surrounds the lug 19. At its upper end, the lug 19 is provided with a shoulder 20 the outer diameter of which is greater than the inner diameter of the opening 16. A hollow cylindrical lug 17 adjoins the combustion chamber wall 14 at the edge of the opening 16. The hollow lug 17 surrounds the lug 19. The free end of the hollow lug 17 is located beneath the shoulder 20 and, in the position shown in FIG. 1, is spaced from the shoulder 20. A web 2*a,* which is connected with the cylindrical wall 2 of the combustion chamber 1, serves as a stop for the lug 19 and thereby insures a proper positioning of the separation plate 18 in an expanded condition of the combustion chamber 1.

Figure 2:
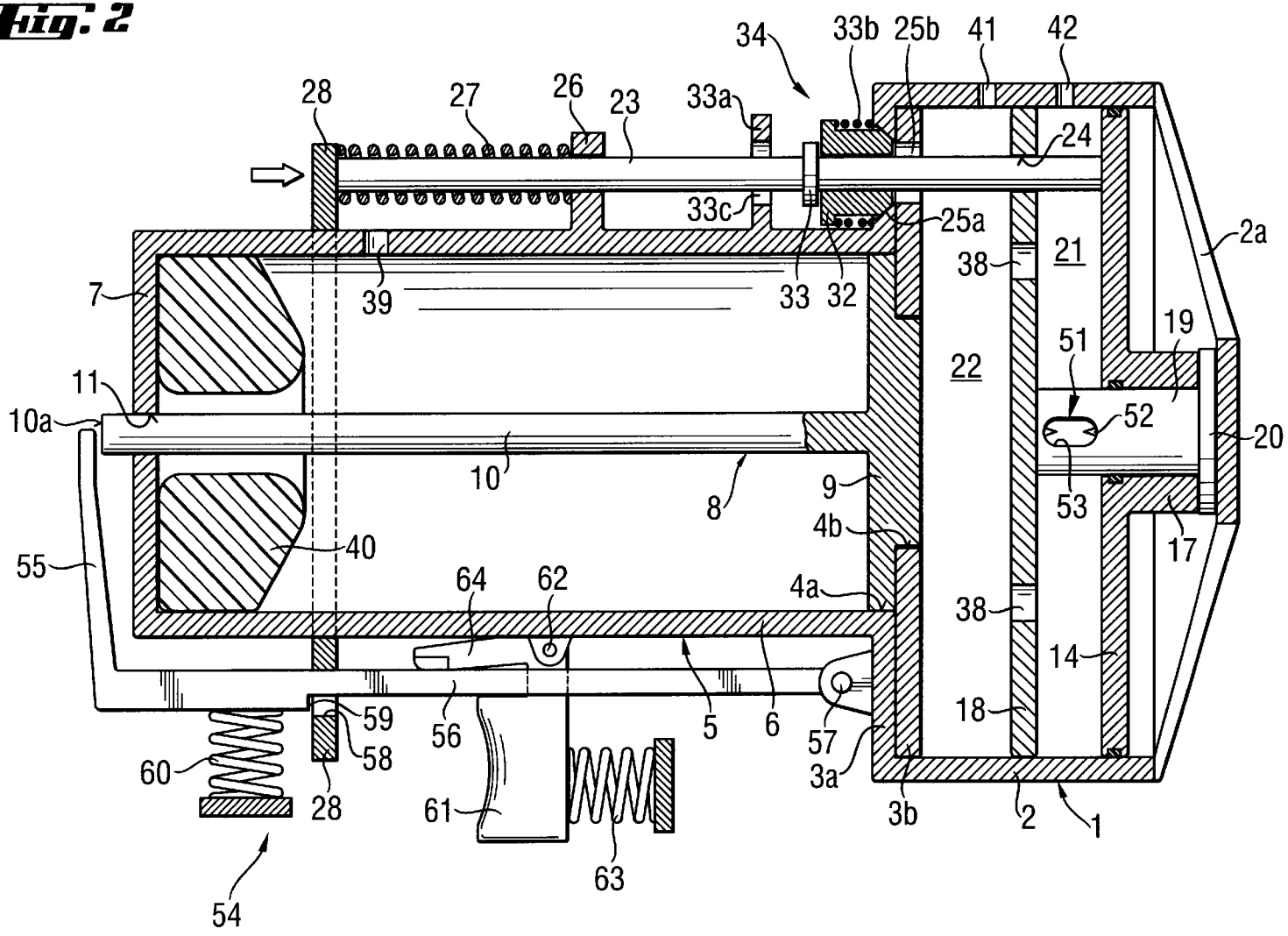
FIG. 2 an axial cross-sectional view of the power tool shown in FIG. 1 in its pressed-on condition with expanded combustion chamber sections.

In a non-operative position of the power tool, the separation plate 18 lies on the bottom plate 3*b,* and the combustion chamber wall 14 lies on the separation plate 18. This position of the separation plate 18 and the combustion chamber wall 14 corresponds to a completely collapsed condition of the combustion chamber 1. When the power tool is pressed against a constructional component (not shown) into which a fastening element is to be driven in, the combustion chamber wall 14 is, as it will be explain later, lifted and becomes spaced from the separation plate 18 or the bottom plate 3*b,* as the case may be. After a certain time period, the combustion chamber wall 14 engages the shoulder 20 of the lug 19 of the separation plate 18. In this position of the combustion chamber wall 14, it is separated from the separation plate 18 a predetermined distance, forming a so-called fore-chamber section of the combustion chamber 1. The fore-chamber section is designated with a reference numeral 21 (FIG. 2). Upon lifting of the combustion chamber wall 14 further, the combustion chamber wall 14 and the separation plate 18 are displaced together parallel to each other, and a further chamber section is formed between the separation plate 18 and the bottom plate 3*b* or the piston plate 9. This chamber section is called a main chamber section and is designated with a reference numeral 22 (FIG. 2). FIG. 2 shows a condition of the combustion chamber 1 in which both combustion chamber sections, the fore-chamber section 21 and the main chamber section 22, are completely expanded. In this position of the combustion chamber 1, the shoulder 20 of the lug 19 of the separation plate 18 engages the stop-forming web 2*a.*

For displacing the combustion chamber wall 14, there are provided several, e.g., three actuation or drive rods 23 uniformly distributed along the circumference of the combustion chamber wall 14 and fixedly connected therewith. Only one of the drive rods 23 is shown in the figures. The drive rods 23 extend parallel to the axis of the combustion chamber 1 and outside of the cylindrical wall 6 of the guide cylinder 5. The drive rods 23 extend through openings 24, respectively, formed in the separation plate 18 and through corresponding openings 25*a,* 25*b* formed in the in the bottom 3*a,* 3*b.* The openings 25*a,* 25*b* simultaneously serve as ventilation openings, with the openings 25*b* having a conical shape. The drive rods 23 and the combustion chamber wall 14 are connected with each other, e.g., by screws in per se known manner. The free ends of the drive rods 23 are connected with the drive ring 28 which, thus, connects the drive rods 23 with each other. The drive ring 28 is arranged concentrically with the combustion chamber axis and surrounds the guide cylinder 5. The drive ring 28 is connected with the drive rods 23 by screws, but other suitable connecting means can also be used. A shoulder 26, through which the drive rods 23 extend, is formed on the guide cylinder wall 6 in a spaced relationship to the drive ring 28. Compression springs 27 extend between the drive ring 28 and the shoulder 26. The compression springs 27 are so arranged that they always pull the combustion chamber wall 14 in a direction toward the bottom plate 3*b.*

As it has already been discussed above, the openings 25*a,* 25*b* serve also as ventilation openings, and valve tappets 32 are provide for displacement into the openings 25*a.* In the open condition of the openings 25*a,* 25*b,* the valve tappets 32 are located outside of the combustion chamber 1, i.e., beneath the bottom plate 3*a.* The valve tappets 32 are supported on a shoulder 33*a* formed on the cylindrical wall 6 of the guide cylinder 5. Compression springs 33*b* are arranged between the valve tappets 32 and the edges of respective openings 25*a,* applying pressure to the valve tappets 32, biasing them toward the shoulder 33*a.* When the drive ring 28 is displaced in a direction toward the bottom plate 3*a,* shoulders 33 provided on the drive rods 23 engage the valve tappets 32 and carry them, against the biasing force of the compression springs 33*b,* into the openings 25*a,* 25*b,* closing the valves 34. The valves 34 are formed as suction/discharge valves. The shoulders 33, which are provided on the drive rods 23 are displaced through the openings 33*c* provided in the shoulders 33*a.*

A plurality of openings 38 are distributed over the circumference of the separation plate 18 at the same distance from the combustion chamber axis. In the lower end of the guide cylinder 5, there are formed a plurality of outlet openings 39 for evacuating air from the guide cylinder 5 when the piston 8 is displaced toward the bottom 7 of the guide cylinder 5. At the lower end of the guide cylinder 5, there is provided damping means 40 for damping the movement of the piston 8. When the piston 8 passes past the openings 39, an exhaust gas can escape through the openings 39.

Two radial, axially spaced openings 41 and 42 are formed in the cylindrical wall 2 of the combustion chamber 1. A liquefied fuel gas is delivered into the combustion chamber 1 though the radial openings 41, 42.

FIG. 2, as it has been discussed above, shows the inventive power tool, which is formed as a setting tool, in the expanded condition of the combustion chamber sections, i.e., in the expanded condition of the fore-chamber section 21 and the main chamber section 22. The displacement positions of the combustion chamber wall 14 and the separation plate 18 is fixed upon the valve tappets 32 entering the ventilation openings 25*a,* 25*b,* which prevents further displacement of the drive rods 23 and thereby the displacement of the combustion chamber wall 14 and with the shoulder 20 of the lug 19 of the separation plate 18 abutting the stop-forming web 2*a.*

The lug 19 forms, in its region adjacent to the separation plate 18, an ignition cage 51 for receiving an ignition element 52. The ignition element 52 serves for generating an electrical spark for the ignition of the air-fuel gas mixture in the fore-chamber 21. As it will be described in more detail below, the ignition element 52 is located in the central region of the cage 51 having openings 53 formed in the cage circumference. Through these openings 53, a laminar flame front exits from the ignition cage 51 into the fore-chamber 21.

As it is further shown in FIG. 1, adjacent to the guide cylinder 5, there is provided a locking/release device 54 which is connected with an inquiry element 55 for inquiring the displacement position of the piston 8 or the piston rod 10.

The locking/release device 54 serves for locking the drive ring 28 and thereby the suction/discharge valves 34 in their closed positions. To this end, the locking/release device 54 includes a locking lever 56 that extends parallel to the longitudinal extend of the guide cylinder 5 at a small distance from the cylindrical wall 6 of the guide cylinder 5. The locking lever 56 is pivotally supported at its rear end on the bottom plate 3*a.* For supporting the locking lever 56, a pivot support 57 is provided on the outer side of the bottom plate 3*a.* The locking lever 56 has its end remote from the support 57 extending through an opening 58 formed in the drive ring 28. The locking lever 56 is formed integrally as one-piece with a feeler that forms the inquiry element 55. The end of the inquiry element 55 is located immediately below an end surface of the piston rod 10 when the piston 8 is located in its initial position. The part, which forms the locking lever 56 and the feeler-shaped inquiry element 55 can be stamped out of a strong metal sheet. On its side remote from the guide cylinder 5, the locking lever 56 has a locking edge 59 with which the locking lever 56 can engage the drive ring 28 from behind when the drive ring 28 has been pushed sufficiently far toward the bottom 3*a,* 3*b* of the combustion chamber 1. A portion of the locking lever 56 that extends from the support 57 to the locking edge 59 has a relatively small width which increase to form the locking edge 59. The locking lever 56 is pivoted, at the support 57, toward the guide cylinder 5 by a spring 60 supported against an element of power tool housing. Upon pivoting of the locking lever 56, the locking edge 59 becomes disengaged from the edge of the opening 58 of the drive ring 28, when the locking edge 59 is located behind the drive ring 28, and the inquiry element 55 has its free end located in the displacement path of the piston rod 10.

Sidewise of the guide cylinder 5, there is provided a trigger 61 which is pivotally supported on the cylindrical wall 6 of the guide cylinder 5. For pivotally supporting the trigger 61, a support 62 is provided on the cylindrical wall 6. The trigger 61 pivots in a direction toward the bottom 3*a*, 3*b* against a biasing force of a compression spring 63. An actuation section of the trigger 61 lies outside of the locking lever 56. The trigger 61 is formed integrally with a lug 64 extending from the support 62 toward the bottom 7 of the guide cylinder 5. Upon a pivotal movement of the trigger 61 in a counter clockwise direction, the lug 64 engages an edge of the locking lever 56, pivoting the locking lever about the support 57 against a biasing force of the spring 60.

Now, the operation of the first embodiment of a power tool according to the present invention will be described with reference to FIG. 2 in which the same elements are designated with the same reference numerals as in FIG. 1.

FIG. 2 shows a condition in which the tool, which is formed as a setting tool, is pressed with its tip against a constructional component into which a fastening element has to be driven in. Upon the tip being pressed against the constructional component, the drive ring 28 is displaced by a press-on cage (not shown) in a direction toward the combustion chamber 1, causing an expansion of the combustion chamber sections 21 and 22 (with drive rods 23), simultaneously closing the discharge/suction valves 34. Shortly before the combustion chamber sections are completely expanded, the liquefied fuel gas is injected through the openings 41, 42. In its displaced condition, the drive ring 28 is located in front of the locking edge 59. However, the locking edge 59 cannot yet engage the drive ring 28 from behind, as the trigger 61 has not yet been actuated. The free end of the inquire element 55 remains in the path of the piston rod 10 immediately in front of the end surface 10*a* of the piston rod 10.

Figure 3:
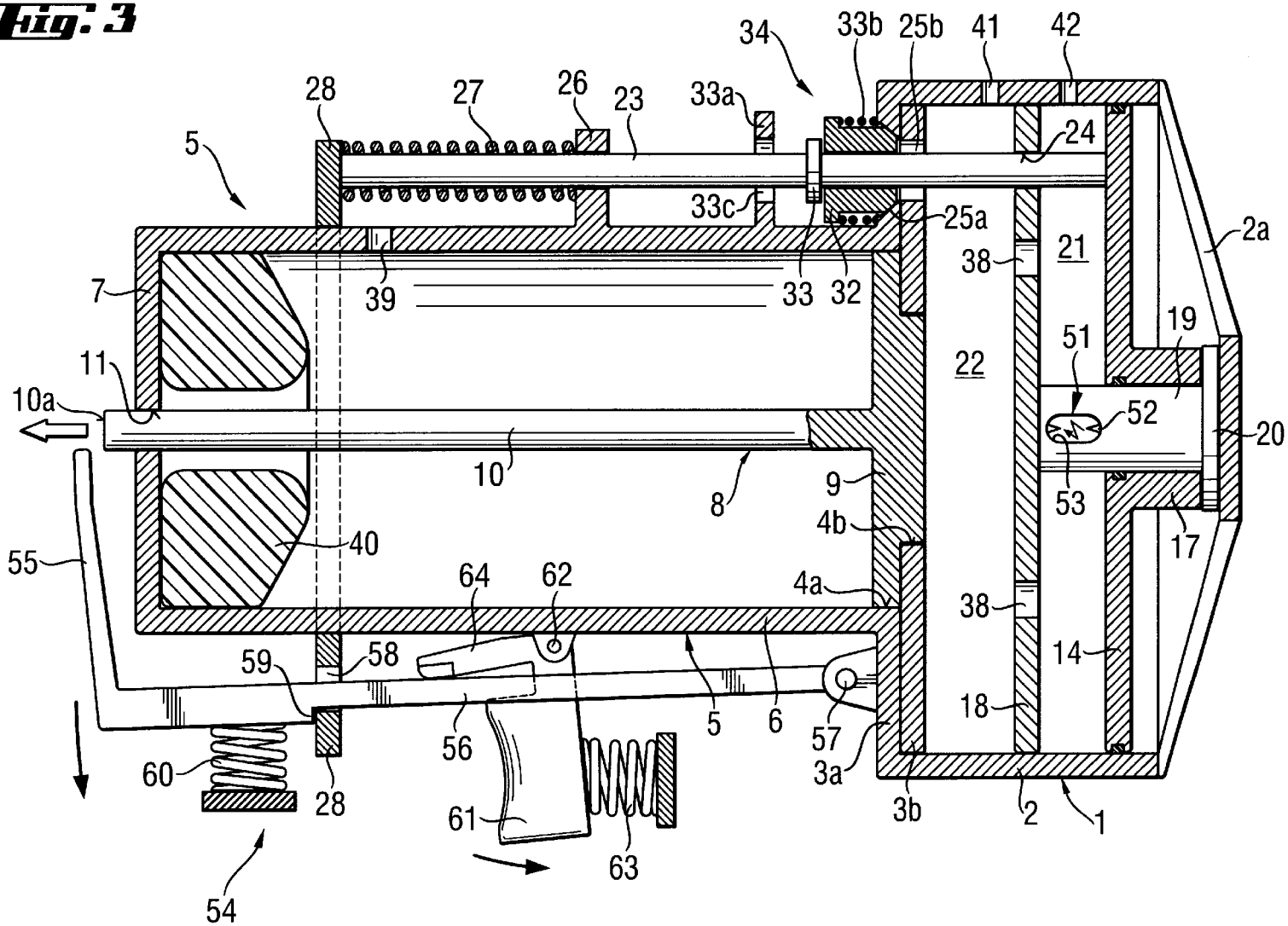
FIG. 3 a view similar to that of FIG. 2 in an ignited condition of the combustion chamber.

FIG. 3 shows a position in which the trigger 61 is actuated, i.e., is pivoted counter clockwise about its support 62 against a biasing force of the spring 63. Upon the pivotal movement of the trigger 61, the lug 64 pivots the locking lever 56 also in the counter clockwise direction about the locking lever support 57, and the locking edge 59 engages from behind the driving ring 28. Simultaneously with the pivotal movement of the locking lever 56, the inquiry element 55 moves out of the path of the piston rod 10. During the last portion of the pivotal movement of the trigger 61 and after the inquiry element 55 has moved out of the path of the piston rod 10, ignition of the gas mixture filling the combustion chamber sections 21, 22 is effected with the ignition element 52. The ignition is effected with a spark produced by the ignition element 52 within the cage 51. First, the mixture starts to burn luminary in the fore-chamber section 21, and the flame front spreads rather slowly in a direction of the openings 38. The unconsumaable air-fuel gas mixture is displaced ahead and enters, through the openings 38, the main section chamber 22, creating there turbulence and precompression. When the flame front reaches the openings 38, it enters the main chamber section 22, due to the reduced cross-section of the openings 38, in the form of flame jets, creating there a further turbulence. The thoroughly mixed, turbulent air-fuel gas mixture in the main chamber section 22 is ignited over the entire surface of the flame jets. It buns with a high speed which significally increases the combustion efficiency.

The combustible mixture impacts the piston 8, which moves with a high speed toward the bottom 7 of the guide cylinder 5, forcing the air from the guide cylinder 5 out through the openings 39. Upon the piston plate 9 passing the openings 39, the exhaust gas is discharged therethrough. The piston rod 10, moving in the direction indicated with an arrow, drives the fastening element in the constructional component against which the power tool is pressed.

Shortly after the ignition of the fuel gas mixture, the trigger 61 can be released. This results in the locking lever 56 moving, together with the inquiry element 55, toward the guide cylinder 5 under the action of a biasing force applied by the spring 60. However, this movement of the locking lever 56 does not lead to the disengagement of the locking edge 59 from the drive ring 28 because the free end of the inquiry element 55 engages the piston rod 10, preventing further pivotal movement of the locking lever 56 about the support 57 in the clockwise direction. Thus, the drive ring 28 remains in its displaced position, the suction/discharge valves 34 remain, therefore, closed and the combustion chamber sections 21, 22 remain in their expanded condition.

Figure 4:
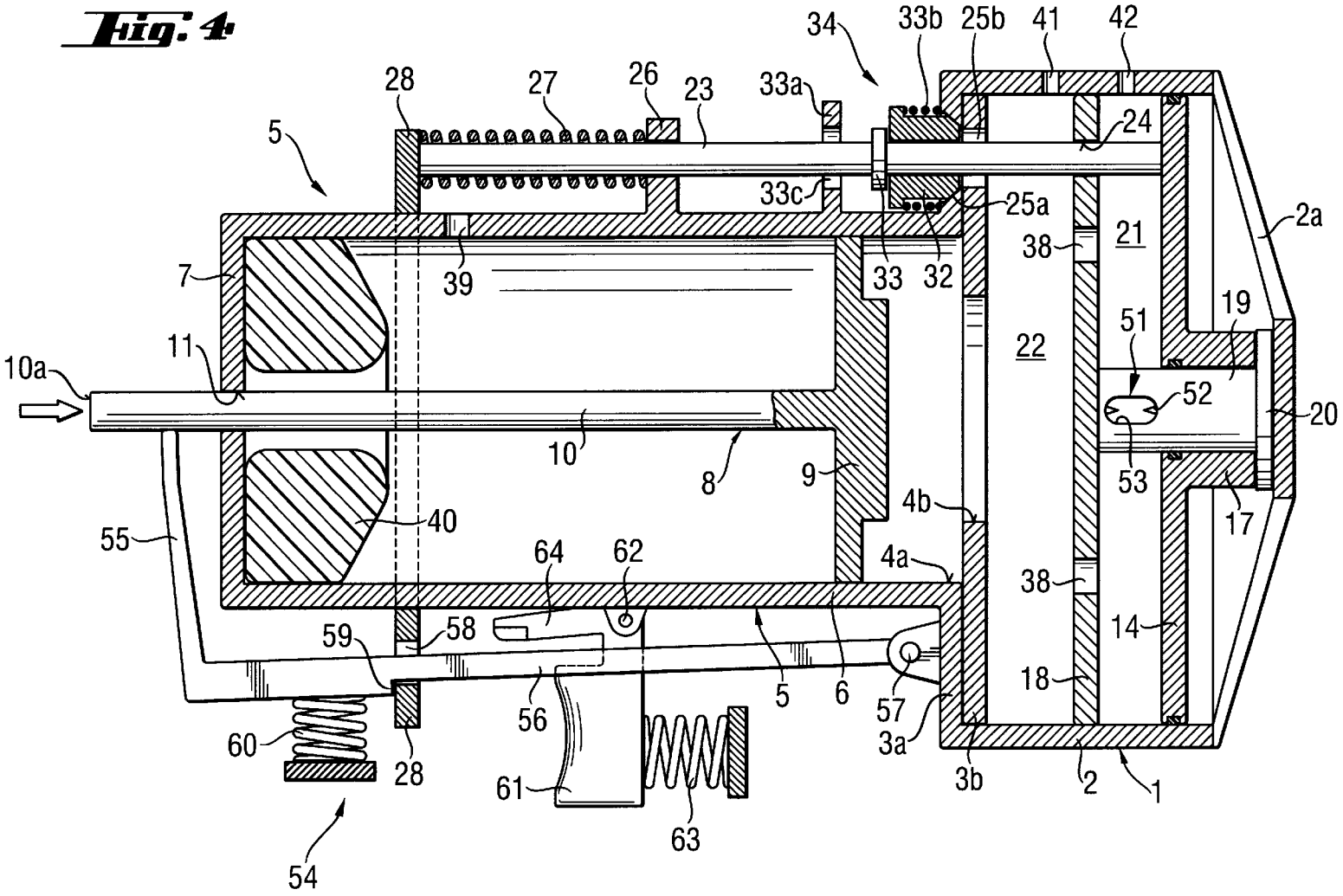
FIG. 4 a view similar to those of FIGS. 1–3 illustrating a condition during return of the piston into its initial position.

FIG. 4 shows a condition of the inventive power tool after setting of the fastening element or following the combustion of the air-fuel gas mixture. The piston 8 is being brought to its initial position as a result of thermal feedback produced by cooling of the flue gases which remain in the combustion chamber 1 and the guide cylinder 5. As a result of cooling of the flue gases, an underpressure is created behind the piston 8 or behind the piston plate 9 which provides for return of the piston 8 to its initial position. The inquiry element 55 slides along the piston rod 10 as the piston 8 is being brought to its initial position so that the drive ring 28 remains engaged by the locking edge 59, and the suction/discharge valves 34 remain closed as the piston 8 has not yet reached its initial position.

Figure 5:
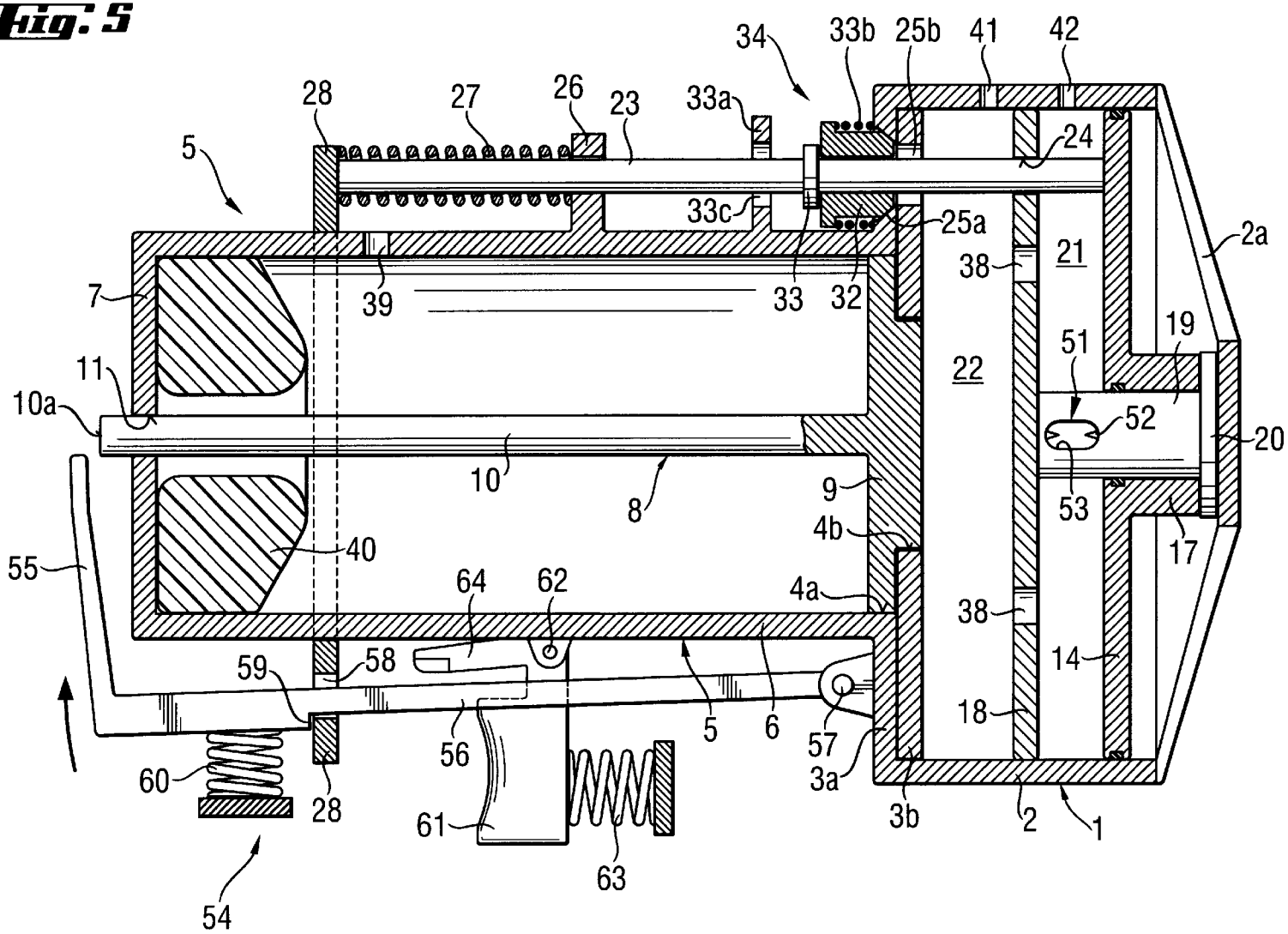
FIG. 5 a view similar to that of FIG. 1 after the piston has returned into its initial position.

FIG. 5 shows a condition of the inventive power tool in which the piston 8 has completely returned to its initial position, with the piston plate 9 completely closing the central bottom opening 4*a*, 4*b*. The piston 8 has been retracted into the guide cylinder 5 to such an extent that the free en 10*a* becomes located outside of the region of the inquiry element 55.

Figure 6:
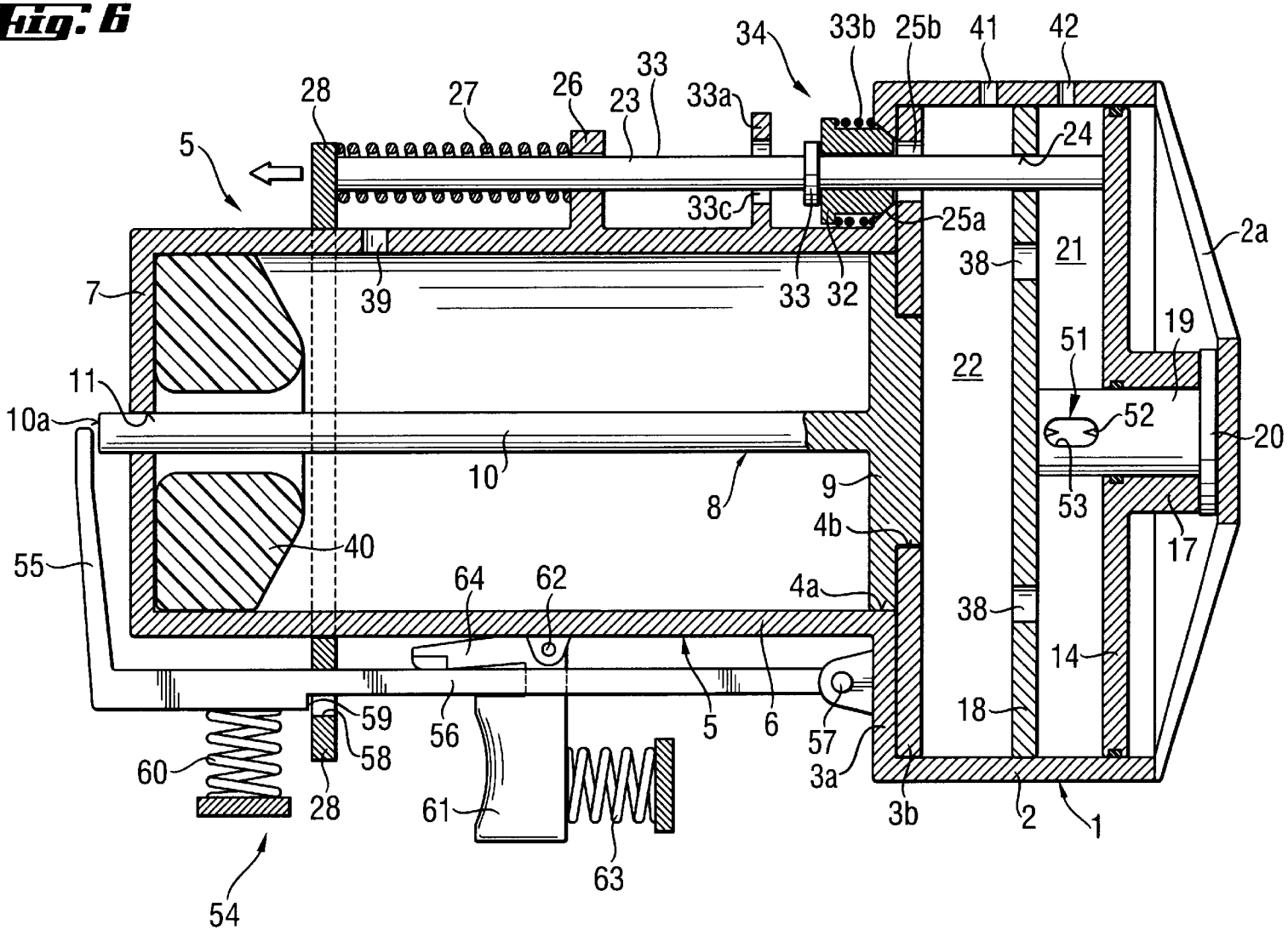
FIG. 6 a view similar to that of FIG. 1 in a release condition of the power tool.

FIG. 6 shows a position in which both the locking lever 56 and the inquiry element 55 have been pivoted to their original position, with the locking edge 59 being disengaged from the drive ring 28 which can now move to its initial position.

In a next step, not shown in the drawings, the drive ring 28 is pushed away from the bottom 3*a*, 3*b* of the combustion chamber 1 by springs 27, entraining with it the drive rods 23. The shoulders 33, which are provided on the drive rods 23, likewise move away from the bottom 3*a*, 3*b*, and the springs 33*b* push respective valve tappets 32 out of the ventilation openings 25*a*, 25*b*. With the displacement of the drive rods 23, toward the front of the power tool, the combustion chamber wall 14 and the separation plate 18 move toward the bottom 3*a*, 3*b* of the combustion chamber 1, leading to the collapse of the combustion chamber sections 21, 22. The residual gases, which remain in the combustion chamber 1 are discharged through the openings 25*a*, 25*b*, with the suction/discharge valves 34 being open. The valves 34 also serve for admitting fresh air into the combustion chamber 1 upon the movement of the combustion chamber wall 14 and the separation plate 18 away from the bottom 3*a,* 3*b.*

Figure 7:
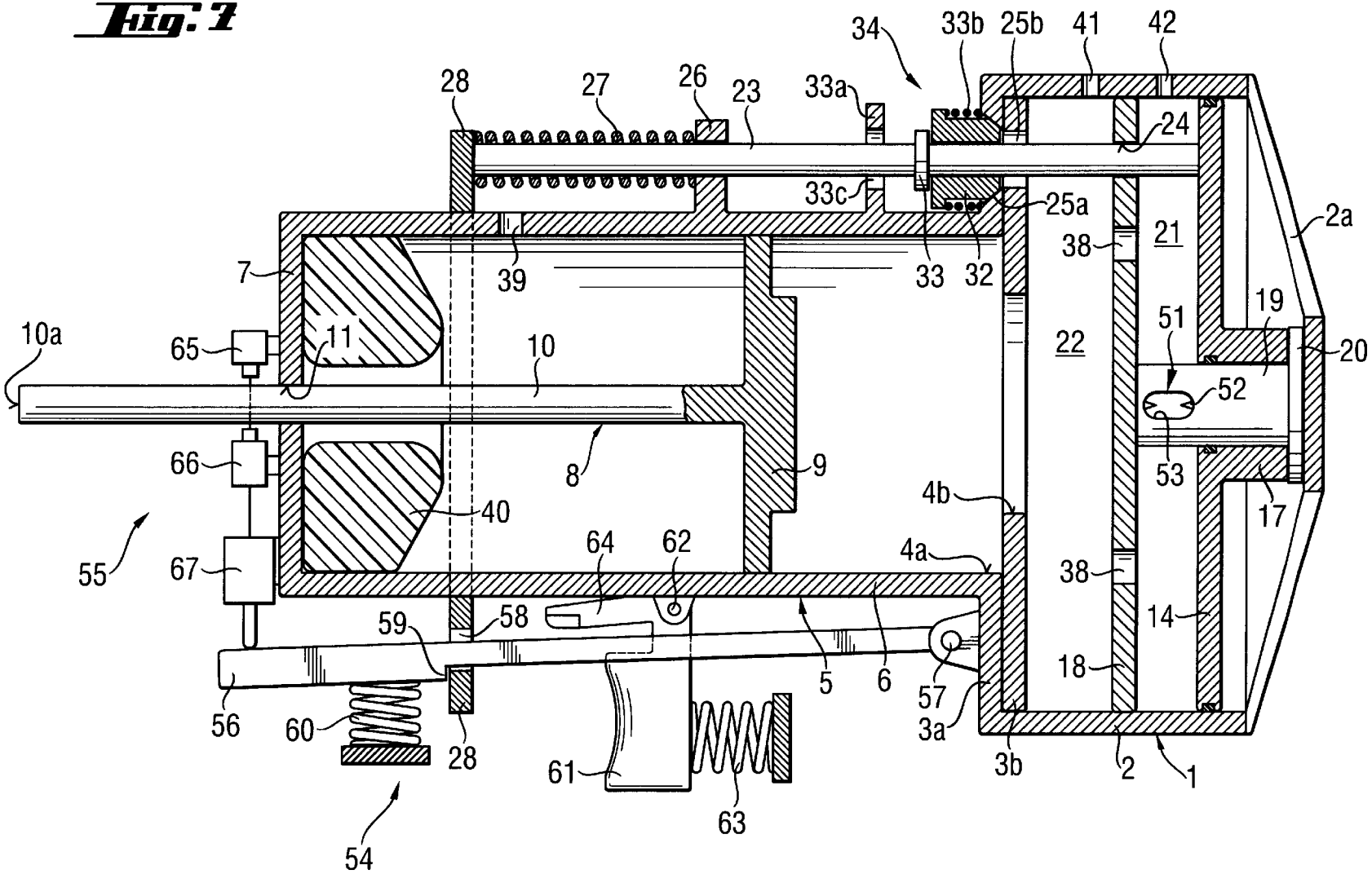
FIG. 7 an axial cross-sectional view of a second embodiment of a power tool according to the present invention in the region of its combustion chamber.

FIG. 7 shows, as discussed above, a second embodiment of the power tool according to the present invention which differs from the first embodiment in that the inquiry element 55 is formed as an electric sensor unit. The sensor unit can be formed, e.g., as an electric photo barrier consisting of a light source, sender 65, and a light receiver 67 arranged at the outer side of the bottom 7 of the guide cylinder 5 on opposite sides of the opening 11 in the bottom 7 in such a way that the light path extends beneath the end surface 10*a* of the piston rod 10 of the piston 8 in the initial position of the piston 8, i.e., in the position of the piston 8 in which the piston plate 9 completely closes the opening 4*a,* 4*b* in the bottom 3*a,* 3*b* of the combustion chamber 1.

After the ignition of the fuel gas mixture in the combustion chamber sections 21, 22 and displacement of the piston 8 into its operational position, the piston rod 10 is located between the light sender 65 and a the light receiver 66 so that no light reaches the light receiver 66. An electrically actuated setting device 67 continues to retain the locking lever 56 in its locking position even after release of the trigger 61, with the locking edge 59 engaging the drive ring 28. Only after the return of the piston 8 in its initial position, the piston rod 10 unblocks the light path between the sender 65 and the receiver 66. After receiving a light signal, the receiver 66 sends a release signal to the setting device 67 which provides for pivotal movement of the locking lever 56 about its support 57 in the clockwise direction. As a result of this pivotal movement of the locking lever 56, the locking edge 59 becomes disengaged from the drive ring 28, providing for displacement of the drive ring 28 away from the combustion chamber 1 and for opening of the suction/discharge valves 34.

Figure 8:
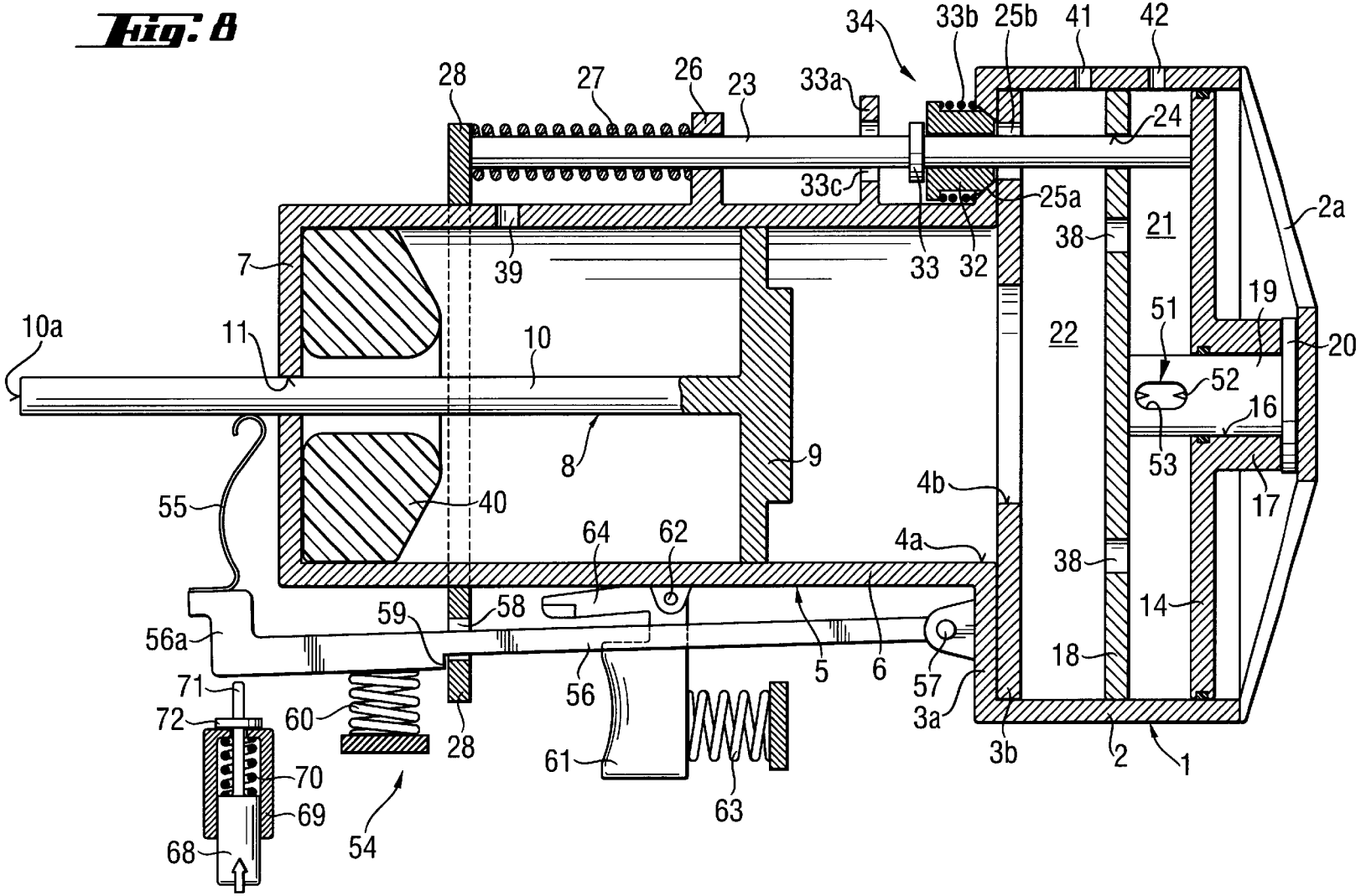
FIG. 8 an axial cross-section view of a third embodiment of a power tool accordingly to the present invention in the region of its combustion chamber.

The embodiment of the power tool shown in FIG. 8 differs from the previously shown and discussed embodiments in that the inquiry element 55 is formed as a flexible element in form of a leaf spring. The rear end of this leaf spring is fixedly attached to a projecting heel 56*a* provided at the free end of the locking lever 56. The opposite, front end of the leaf spring is convexly bent and is pressed against the circumference of the piston rod 10. The front, convexly bent end of the leaf spring-shaped, inquiry element 55 is biased into engagement with the piston rod 10 by the spring 60. However, the biasing force applied by the spring 60 is not sufficiently large to dislodge the locking edge 59 from engagement with the drive ring 28. If for some reason, the piston 8 is not returned into its initial position, the condition shown in FIG. 8 does not changed. Still, the release of the drive ring 28 can be effected with a push-button 68 which is displaceably arranged in the housing of the power tool. The push-button 68 is located in a support element 69 and is displaced against a biasing force of a return spring 70. Upon displacement of the push-button 68 the actuation rod 71 displaces the locking lever 56 in a direction toward the piston rod 10. The leaf spring-shaped inquiry element 55 bents resiliently further, and the locking edge 59 becomes disengaged from the drive ring 28. With the drive ring 28 moving away from the combustion chamber 1, the combustion chamber becomes deaerated. Upon release of the push-button 68, the return spring 70 pushes the push-button 68 in its initial position in which the shoulder 72 provided on the rod 71 lies on the surface edge of the support 69. The locking lever 56 remains in its release position because the drive ring 28 is located leftward of the locking edge 59.

Upon subsequent displacement and locking of the drive ring 28 and ignition of the fuel gas mixture in the combustion chamber 1, and a subsequent return of the piston 8 into its initial position, the front end of the leaf spring-shaped inquiry element 55 can be displaced, under the action of the spring 60, into a position beneath the end surface 10*a* of the piston rod 10, with the locking edge 59 being disengaged from the drive ring 28.

Figure 9:
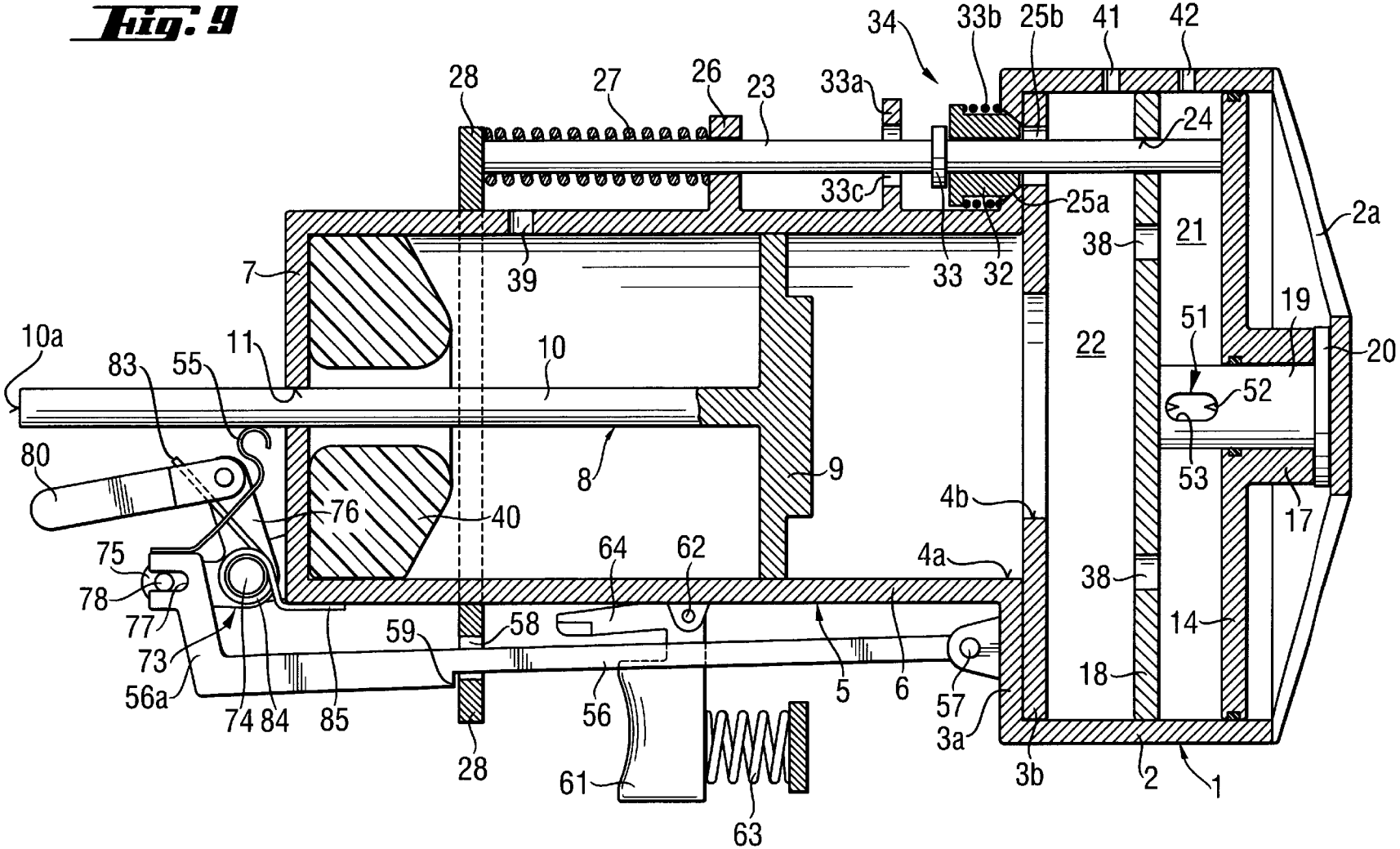
FIG. 9 an axial cross-sectional view of a fourth embodiment of a power tool according to the present invention in the region of its combustion chamber.
Figure 10:
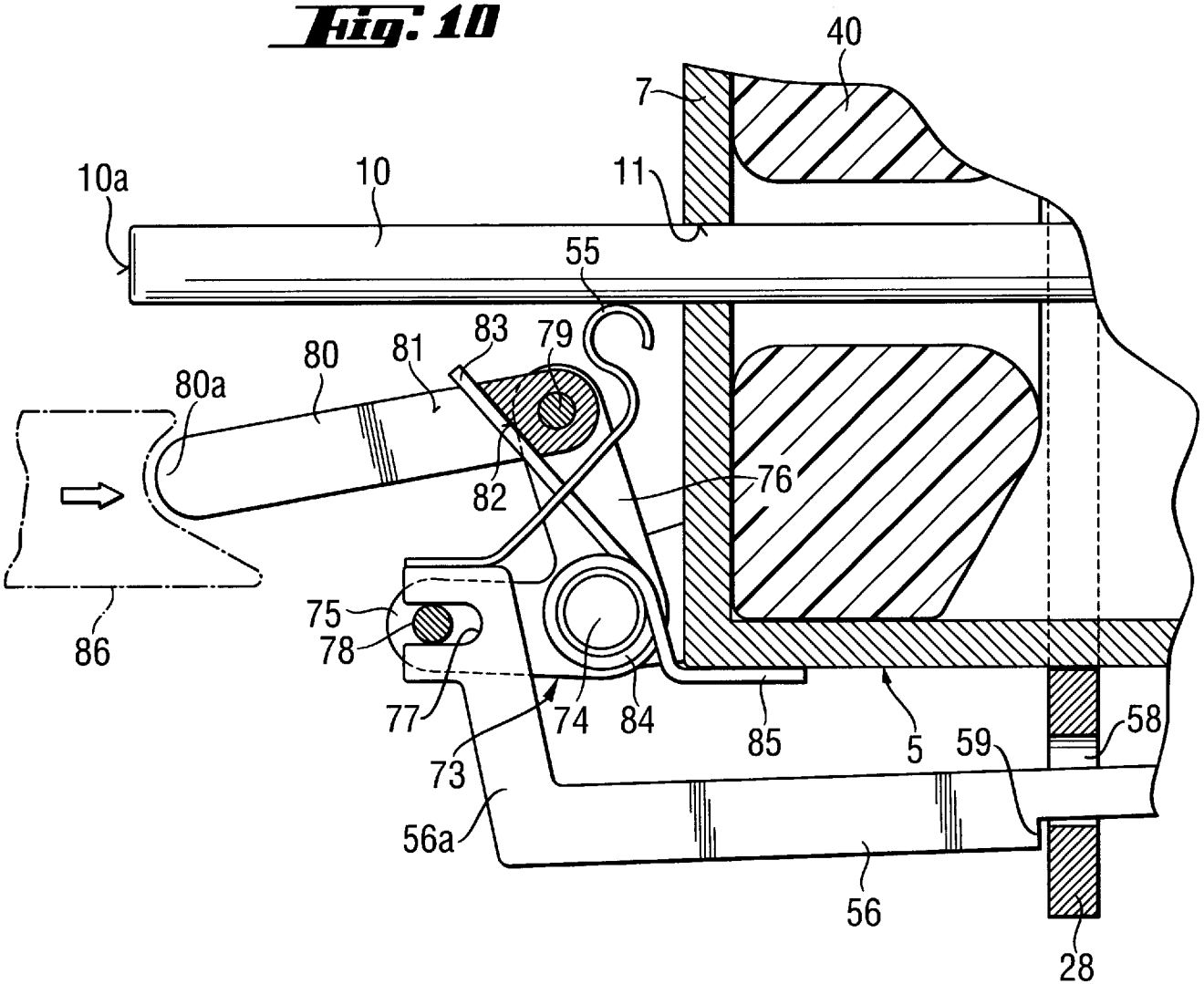
FIG. 10 a cross-sectional view of a portion of a front region of the power tool shown in FIG. 9 at an increased scale.

FIGS. 9–10, which show a fourth embodiment of the inventive power tool, show a condition of the power tool in which the piston 8 has not yet reached its initial position after the completion of the setting process and is immovable. In this case, likewise, a forced released is provided, which is needed because the setting tool is again pressed with its tip against the constructional component.

To this end, an angular lever 73, which is supported for a pivotal movement about an axle 74 on the outer side of the bottom 7 of the guide cylinder 5, is provided. The axle 74 is located in the apex region of the angular lever 73 which has two legs, a first leg 75 and a second leg 76 connected with each other at the apex. Both legs 75 and 76 lie in a plane extending perpendicular to the axial extent of the axle 74 which, e.g., can extend tangentially to the guide cylinder 5. The first leg 75 extends toward the front of the setting tool whereas the second leg 76 extends toward the piston rod 10.

At the free end of the first leg 75, there is provided an axle stub 78 which is located in a slot 77 provided in the free end 56*a* of the locking lever 56. The free end 56*a* is formed by tangent-bending an end section of the locking lever 56 remote from the locking lever support 57. The slot 77 extends in the longitudinal direction of the setting tool or the piston rod 10. A leaf spring-shaped inquiry member 55 is secured at its rear end to the free end of the free end section 56*a* of the locking lever 56. The front end of the leaf-spring-shaped inquiry element 55 is convexly bent and is pressed against the piston rod 10. The inquiry element 55 serves for sensing the position of the piston rod 10.

The second leg 76 of the angular lever 73 is provided at its free end with an axle stub 79 on which set lever 80 is pivotally supported. The set lever 80 is formed as a unidirectionally extending section. The lever 80 has a slot 81 having a stop edge 82 against which a leg 83 of a leg spring 84 is pressed. The leg spring 84 is wound about the axle 74 and has its other leg 85 supported on the cylindrical wall 6 of the guide cylinder 5. The leg 83 of the leg spring 84 is constantly pressed against the stop edge 82 for applying a biasing force, via the set lever 80, to the angular lever 73 for rotating same about the axle 74 in the clockwise direction. The position of the stop edge 82 in the set lever 80 is so selected that the leg spring 84 so positions the set lever 80 that it extend toward the front end of the setting tool and at a predetermined angle to the piston rod 10. This angle is so selected that, in case the piston 8 does not reach its initial position and the front end of the leaf-spring-shaped inquiry element 55 is pressed against the piston rod 10, the free end 80*a* of the set lever 80 is surrounded by an extension 86 of a press-on cage (not shown) that upon the setting tool being pressed against a constructional component, is displaced toward the rear end of the setting tool.

The operation of the setting tool shown in FIGS. 9–10 will be now described for a case when the piston 8 does not reach its initial position and is immovable, i.e., is in the condition shown in FIGS. 9–10.

For releasing the drive ring 28 and for dearating the combustion chamber 1, the setting tool is again pressed with its tip against the constructional component. Upon the setting tool tip being pressed against the constructional component, the press-on cage, which was mentioned above, is displaced inward, together with its extension 86. Because the leaf-spring inquiry element 55 is pressed against the piston rod 10, the leg spring 84 can pivot the angular lever 73 only a small predetermined amount. The spring leg 83, which is pressed against the stop edge 82 of the set lever 80, so aligns the set lever 80 that the free end 80*a* of the set lever 80 is grasped by the extension 86. The extension 86 presses the set lever 80 backward. As a result, the angular lever 73 is pivoted by the set lever 80 in a clockwise direction about the axle 74. At that, the first leg 75 of the angular lever 73 moves toward the piston rod 10, compressing the inquiry element-forming leaf spring. Upon displacement of the first leg 75 toward the piston rod 10, the locking lever 56 is pivoted by the stub 78 about the support 57, which results in disengagement between the locking edge 59 and the drive ring 28. The drive ring 28 moves toward the front of the setting tool, causing deaeration of the combustion chamber 1. When the press-on cage, together with the extension 86, is displaced back to the front end of the setting tool, the angular position of the angular lever 73 does not change because locking lever 56 cannot move back because its thick section lies in the opening 58 of the drive ring 28 because of the movement of the drive ring 28 to the front of the setting tool. The locking lever 56 retains, with its slot 77, the stud 78 and thus, the angular lever 73, in its new position.

During the displacement of the set lever 80 by the extension 86 backward, the set lever 80 becomes engaged by a convex section of the extension 86 to prevent the set lever 80 from turning back. The displacement of the set lever 80 causes the rotation of the angular lever 73 in FIG. 10 in the clockwise direction and, as a result, the leg 83 of the leg spring 84 forms an acute angle with the stop edge 82. This acute angle opens in a direction toward the leg 85. When, after the release or lifting off of the locking lever 56, the extension 86 moves forward, the set lever 80 is further pivoted in the clockwise direction by the leg 83 about the axle stub 79. The set lever 80, at a subsequent application of the tool against the constructional component and rearward movement of the extension 86, would not be engaged by the extension 86, and the set lever 80 would be located above the extension 86.

Upon the second application of the tool against the constructional component, the combustion chamber will again be filled with the fuel gas mixture that will be ignited. The piston 8 would be again actuated and finally would return into its initial position. As soon as the piston rod 10 passes the inquiry element-forming leaf spring, it can move back into the region of the piston rod 10, with its front end lying immediately beneath the end surface 10*a* of the piston rod 10.

It follows from the foregoing discussion that in the release condition of the tool, i.e., in the release condition of the drive ring 28, the extension 86 is uncapable of engaging the set lever 80 during initial application of the tool against the constructional component. When after a subsequent application of the tool against the constructional component, the drive ring 28 becomes locked as a result of actuation of the trigger 61, and the locking lever 56 is pivoted away from the guide cylinder 5, the angular lever 73 in FIG. 10 would pivot in the counterclockwise direction about the axle 74. As a result the inquiry element-forming leaf spring would be displaced out of the path of the piston rod 10, the free end 80*a* of the set lever 80 would engage the upper portion of the extension 86, and the leg spring 84 would become preloaded, as a result of the actuation of the trigger 61 and the pivotal movement of the locking lever 56. The engagement of the free end 80*a* of the set lever 80 with the extension 10 leads to an additional excursion of the leg 83 of the leg spring 84 which, however, ascends again as soon as the extension 86, as a result of a recoil, moves relative to the guide cylinder 5. When after the ignition, the piston rod 10 passes, on its displacement back, the inquiry element-forming leaf spring, it again is displaced by the leg spring 84 into the path of displacement of the piston rod 10. As a result, a conventional release of the drive ring 28 takes place. The drive ring 28 becomes released as a result of pivoting of the locking lever 56 which leads to disengagement of the locking edge 59 from the drive ring 28. In this case, a compression spring 60, which is used in the embodiments of FIGS. 1 and 3, becomes unnecessary.

Though the present invention was shown and described with references to the preferred embodiments, such are merely illustrative of the present invention and are not to be construed as a limitation thereof, and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. A portable, internal combustion engined power tool comprising a combustion chamber (1); at least one suction/discharge valve (34) for supplying fresh air into the combustion chamber and for discharging waste gases therefrom; an operational piston (8) displaceable in an operational direction upon ignition of a fuel gas mixture filling the combustion chamber; a locking/release device (54) for releasing the at least one suction/discharge valve (34) after the piston (8) has reached its initial position after having performed an operational stroke; inquiring means (55, 65, 61) for inquiring a displacement position of the piston (8) when it is being displaced to its initial position after having performed the operation stroke and for actuating the locking/release device (54) when the piston (8) has reached its initial position; and a guide cylinder (5) for guiding the piston (8), wherein the piston (8) has a piston rod (10) projecting from the guide cylinder (5), and wherein the inquiring means (55, 65, 66) is arranged outside of the guide cylinder (5).

2. A power tool according to claim 1, wherein the inquiry means (55; 65, 66) comprises sensor means (65, 66) arranged adjacent to a displacement path of the piston rod (10) for generating an electrical release signal when the piston rod (10) passes a region of the sensor means (65, 66).

3. A power tool according to claim 1, wherein the inquiry means comprises a feeler element (55) biased against a circumference of the piston rod (10) and displaceable into the path of displacement of the piston rod (10) when the piston (8) has reached its initial position.

4. A power tool according to claim 3, wherein an end of the feeler element (55) adjacent to the piston rod (10) is formed as an elastic end.

5. A power tool according to claim 3, wherein an end of the feeler element (55) adjacent to the piston rod (10) is formed as a spring.

6. A power tool according to claim 2, comprising means (67) for lifting the locking lever (56) off its locking position in response to the electrical release signal generated by sensor means (65, 66).

7. A power tool according to claim 3, wherein the feeler (55) has an end remote from the piston rod (10) and connected with the locking lever (56).

8. A power tool according to claim 4, further comprising means (68, 80) for displacing the locking lever (56) into its release position if the piston (8) has not reached its initial position after performing the operational stroke.

9. A power tool according to claim 8, wherein the displacing means (68) comprises an actuation button.

10. A power tool according to claim 8, wherein the displacing means further comprises an angular lever (73) privotable about an axle (74) and having a leg (75) for displacing the locking lever (56) into its release position when another leg (76) of the angular lever (73) is displaced by press-on means (86) provided on the power tool, pivoting the angular lever (73).

11. A method of controlling operation a portable, internal combustion engined power tool including a combustion chamber (1), at least one suction/discharge valve (34) for supplying fresh air into the combustion chamber (1) and for discharging waste gases therefrom, and an operational piston (8), the method comprising the steps of inquiring a displacement position of the piston (8) when it is being displaced to its initial position after having performed an operational stroke; and releasing the at least one suction/discharge valve (34) upon the piston (8) reaching its initial position, wherein the tool further includes a guide cylinder (5) for guiding the piston (8), wherein the piston (8) has a piston rod (10) projecting from the guide cylinder (5), wherein the inquiring step comprises inquiring a displacement position of the piston rod outside of the guide cylinder and comprises detecting a position of a free end surface **(10*a*) of the piston rod (10)**.

12. A portable, internal combustion engined power tool comprising a combustion chamber (1); at least one suction/discharge valve (34) for supplying fresh air into the combustion chamber and for discharging waste gases therefrom; an operational piston (8) displaceable in an operational direction upon ignition of a fuel gas mixture filling the combustion chamber; a locking/release device (54) for releasing the at least one suction/discharge valve (34) after the piston (8) has reached its initial position after having performed an operational stroke; and inquiry means (55, 65, 61) for inquiring a displacement position of the piston (8) when it is being displaced to its initial position after having performed the operational stroke and for actuating the locking/release device (54) when the piston (8) has reached its initial position, wherein the locking/release device (54) comprises a locking lever (56), the inquiry means (55, 56, 66) lifting the locking lever (56) when the piston (8) reaches its initial position.

13. A method of controlling operation a portable, internal combustion engined power tool including a combustion chamber (1), at least one suction/discharge valve (34) for supplying fresh air into the combustion chamber (1) and for discharging waste gases therefrom, and an operational piston (8), the method comprising the steps of returning the piston to its initial position as a result of vacuum that was created in the combustion chamber upon displacement of the piston to its operational position; inquiring a displacement position of the piston (8) when it is being displaced to its initial position after having performed an operational stroke; and releasing the at least one suction/discharge valve (34) upon the piston (8) reaching its initial position to provide for aeration of the combustion chamber.

14. A method according to claim 13, wherein the tool further includes a guide cylinder (5) for guiding the piston (8), wherein the piston (8) has a piston rod (10) projecting from the guide cylinder, and wherein the inquiring step comprises inquiring a displacement position of the piston rod outside of the guide cylinder.

15. A method according to claim 13, further comprising the step of forcefully releasing the at least one suction/discharge valve (34) when the piston has not reached its initial position after having performed the operational stroke.

16. A portable, internal combustion engined power tool comprising a combustion chamber (1); at least one suction/discharge valve (34) for supplying fresh air into the combustion chamber and for discharging waste gases therefrom; an operational piston (8) displacement in an operational direction upon ignition of a fuel gas mixture filling the combustion chamber; means (39) for creating vacuum in the combustion chamber, the piston being returned to its initial position upon creation of vacuum in the combustion chamber; a locking/release device (54) for releasing the at least one suction/discharge valve (34) after the piston (8) has reached its initial position after having performed an operation stroke; and inquiry means (55, 65, 61) for inquiring a displacement position of the piston (8) when its is being displaced to its initial position after having performed the operational stroke and for actuating the locking/release device (54) when the piston (8) has reached its initial position.

* * * * *